United States Patent [19]

Kim et al.

[11] Patent Number: 4,614,092

[45] Date of Patent: Sep. 30, 1986

[54] REFRIGERATOR WITH A CLOSEABLE REFRIGERATING COMPARTMENT

[75] Inventors: Dal W. Kim, Kyungnam; Kyung H. Kim, Changwon; Seon H. Kim, Kyungnam, all of Rep. of Korea

[73] Assignee: Gold Star Company, Ltd., Seoul, Rep. of Korea

[21] Appl. No.: 512,703

[22] Filed: Jul. 11, 1983

[30] Foreign Application Priority Data

Jul. 12, 1982 [KR] Rep. of Korea ..... 5478/82[U]
Jul. 12, 1982 [KR] Rep. of Korea ..... 5479/82[U]

[51] Int. Cl.[4] ..... F25D 17/04

[52] U.S. Cl. ..... 62/408; 62/187; 251/251

[58] Field of Search ..... 62/408, 443, 446, 97, 62/187; 251/251; 236/99.6

[56] References Cited

U.S. PATENT DOCUMENTS

| | | | |
|---|---|---|---|
| 2,506,063 | 5/1950 | Carbon | 251/251 X |
| 3,656,314 | 4/1972 | Jung | 62/97 |
| 4,009,589 | 3/1977 | Webb et al. | 62/187 X |
| 4,229,945 | 10/1980 | Griffin et al. | 62/408 X |
| 4,276,754 | 7/1981 | Ty | 62/187 |

*Primary Examiner*—William E. Wayner
*Attorney, Agent, or Firm*—Fliesler, Dubb, Meyer & Lovejoy

[57] ABSTRACT

Disclosed is a refrigerator comprising a freezing compartment and a refrigerating compartment in which the freezing compartment can be used as a refrigerating compartment. The two compartments are in close proximity. Means are provided in a cooling-air passage to supply cooling air generated from an evaporator into both of the compartments or selectively only into one compartment.

1 Claim, 11 Drawing Figures

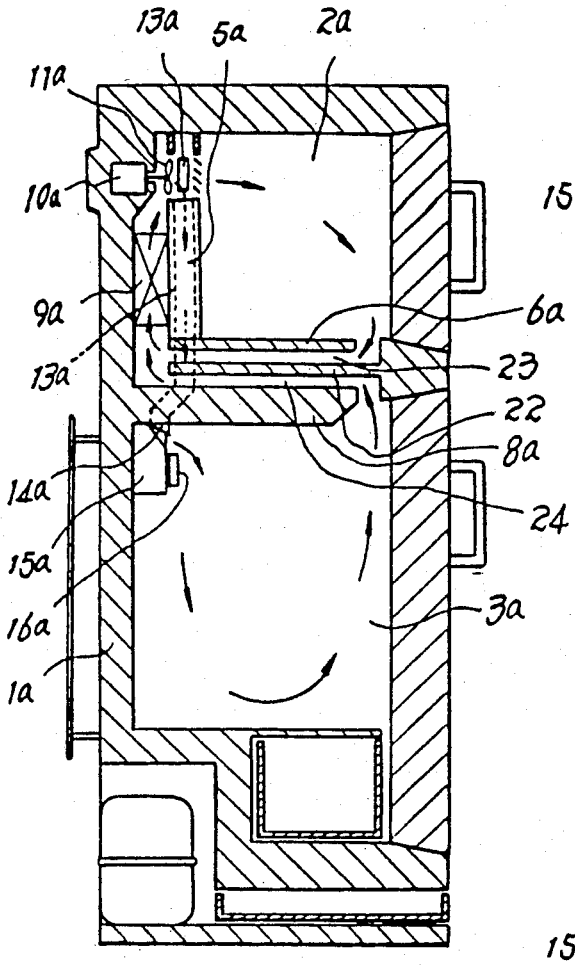
FIG.4
FIG.5(a)
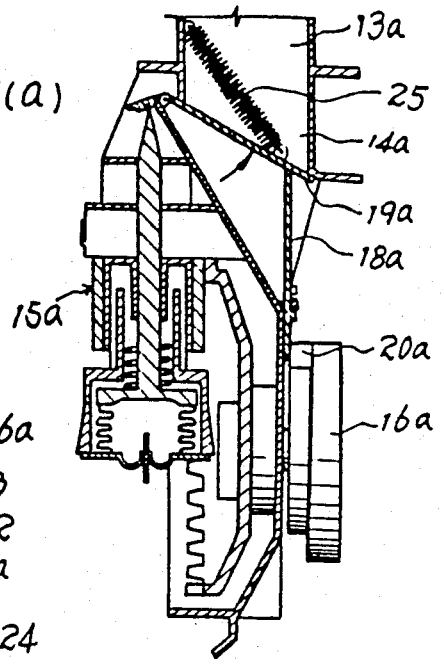
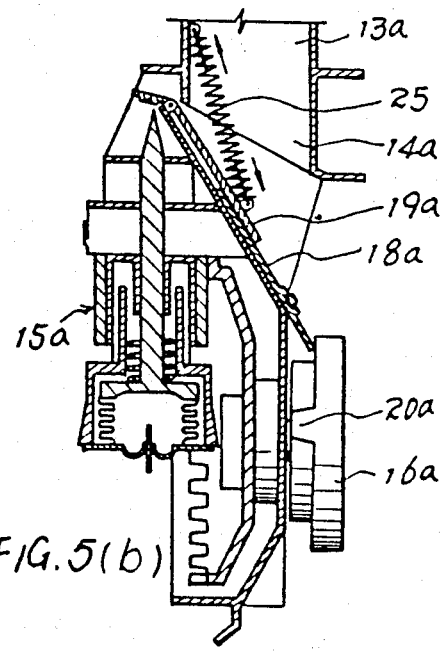
FIG.5(b)

REFRIGERATOR WITH A CLOSEABLE REFRIGERATING COMPARTMENT

FIELD OF THE INVENTION

This invention relates to a refrigerator comprising a freezing compartment and a refrigerating compartment, wherein the refrigerating compartment may be closed if desired, and the freezing compartment may be used alone or alternatively may be used as a freezing or as a refrigerating compartment.

BACKGROUND OF THE INVENTION

In a conventional refrigerator, the freezing compartment and refrigerating compartment generally cannot be operated independently of each other. At times, the overall operation of both the refrigerating compartment and the freezing compartment is not necessary. For example, in a winter season or at other times when the amount of food to be refrigerated is small, the operation of both compartments of the refrigerator causes a waste of electrical power. Recently, new forms of refrigerators have been utilized. For example, when the amount of food to be refrigerated is large, the freezing compartment is capable of being used as a refrigerating compartment thereby allowing the capacity for refrigeration to be increased. In such new refrigerators, however, there have been problems which have made it impossible to maintain the refrigerating temperature at the desired level during certain periods. As with the conventional refrigerators, the new refrigerators also have the disadvantage of wasting electrical power, because both the refrigerating compartment and the freezing compartment are always operated even when the amount of food to be refrigerated is small.

SUMMARY OF THE INVENTION

Accordingly, a primary object of the invention is to provide a refrigerator which eliminates the problems encountered in the conventional and other forms of refrigerators and to avoid the waste of electrical power.

Another object of the invention is to provide a refrigerator with a closeable refrigerating compartment, wherein the cooling-air incoming passage can be closed, if desired, so that the refrigerating compartment is closed and only the freezing compartment is used as either a freezing or a refrigerating compartment.

Still another object of the invention is to provide a refrigerator with a closeable refrigerating compartment wherein closing of the cooling-air incoming passage of the refrigerating compartment is effected by using the cooling-air flow regulator disposed at the inlet of said passage of a refrigerator.

A still further object of the invention is to provide a refrigerator with a closeable refrigerating compartment wherein closing of the cooling-air incoming passage of the refrigerating compartment is effected by a shutter disposed at a certain position in said passage and easily closed and opened by the rotation of the actuating knob in the existing refrigerator.

According to the present invention, these and other objects are accomplished by a refrigerator comprising two compartments.

More particularly, this invention is a refrigerator comprising a freezing compartment and a refrigerating compartment in which the freezing compartment can be used as a refrigerating compartment. The two compartments are in close proximity, for example, arranged upwards and downwards of each other. An evaporator is disposed in close promixity to the compartments, for example, between the compartments, or at the rear wall of the freezing compartment. A cooling-air flow regulator is located in a cooling-air passage and is adapted to supply cooling air generated from the evaporator into both of the compartments.

In one embodiment, for selective closing of the refrigerating compartment, a shutter is disposed in the cooling-air passage connected to the refrigerating compartment. The shutter is adapted to open and close said passage.

When the refrigerating compartment is not required, such as in a winter season or at other times when the amount of food to be refrigerated is small, the refrigerating compartment is closed and only freezing compartment is used as either a freezing or as a refrigerating compartment.

According to another embodiment of this invention, rather than use of the cooling-air flow regulator as described above, closing of the cooling-air incoming passage is effected by a shutter disposed in said passage. In this case, the shutter is able to be opened and closed, for example, by means of a drive shaft and an actuating knob connected to one end of the shaft.

In the embodiments of this invention as described above, when refrigerating compartment is not to be used, it is possible to close the refrigerating compartment and to use only the freezing compartment simply by rotating the control knob on the cooling-air flow regulator or by actuating the knob of the shutter-drive shaft, thereby saving electrical power.

These and other objects and novel features of this invention will be more apparent from the following description of the embodiments of the invention in accordance with the accompanying drawings.

BRIEF DESCRIPTION OF THE DRAWINGS

FIG. 4 is a cross-sectional view of a refrigerator according to another embodiment of this invention.

FIG. 5(*a*) and (*b*) are enlarged cross-sectional views of the cooling-air regulator of FIG. 4; FIG. 5(*a*) shows the condition when the control plate of the cooling-air flow regulator closes the cooling-air incoming passage; FIG. 5(*b*) shows the condition when the control plate opens said passage.

DETAILED DESCRIPTION OF THE PREFERRED EMBODIMENTS

Figure 1:
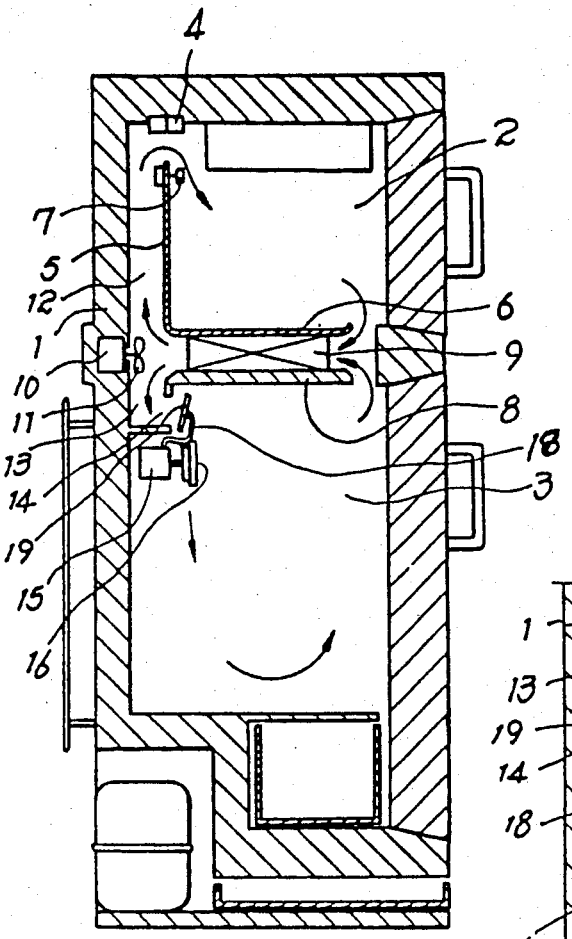
FIG. 1 is a cross-sectional view of a refrigerator according to one embodiment of this invention.

FIG. 1 shows a refrigerator, according to one embodiment of this invention, wherein a body 1 of the refrigerator has a freezing compartment 2 and a refrigerating compartment 3 in upper and lower portions of the interior thereof, respectively.

The freezing compartment 2 is provided at the top surface with thermostat 4 and the compartment 2 is provided at the top end of the rear wall 5 thereof with a switch 7 adapted to convert the freezing compartment 2 into a refrigerating compartment as required. Disposed between the bottom wall 6 of the freezing compartment 2 and the top wall 8 of the refrigerating compartment 3 is an evaporator 9. Rearward of the evaporator 9, a fan motor 10 is mounted on the inner wall of the body 1 of the refrigerator. Fixed on the shaft of the motor 10 is a fan 11, by which the cooling air generated from the evaporator 9 is diverged into upper and lower flows. One part of the cooling air flows, through a cooling-air incoming passage 12 disposed rearward of the rear wall 5 of the freezing compartment 2, into the interior of the freezing compartment 2, and the other part of the cooling-air flows through the cooling-air incoming passage 13 disposed rearward of the top wall 6 of the refrigerating compartment 3, into the interior of the refrigerating compartment 3. At the inlet 14 of the passage 13, a cooling-air flow regulator 15 is disposed to regulate the temperature of the refrigerating compartment 3. The cooling-air flow regulator 15 comprises a bellows-type extendible tube 17 which is movable to be extended and retracted by a control knob 16 having on the front face thereof the indications of cooling extent, such as "Low Cooling", "Middle Cooling", and "High Cooling". The extendible tube 17 is provided with a support lever 18 which is movable according to the extended and retracted movements of the tube 17. At the top end of said support lever 18, a control plate 19 is attached to open and close said inlet 14.

Figure 2:
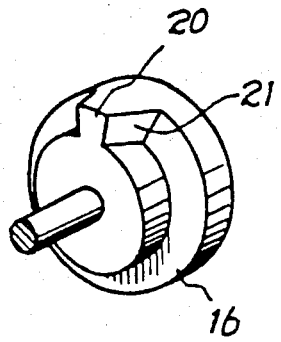
FIG. 2 is a rear perspective view of a control knob of cooling-air flow regulator, disposed within the refrigerating compartment, showing a cam protruded from the rear face of the knob according to this invention.
Figure 3:
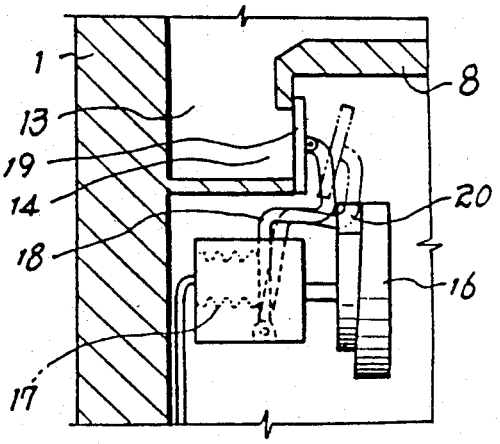
FIG. 3 is an enlarged cross-sectional view of the cooling-air flow regulator of FIG. 1.

In accordance with this invention, the control knob 16 of the cooling-air flow regulator 15 is provided with a cam 20 on a portion of the rear surface, as shown in FIG. 2. A side face 21 of the cam 20 being formed by a sloped surface. Also, on the front face (not shown) of the knob 16, on indication "Close" is provided at a position corresponding to the cam 20. With this arrangement, when the knob 16 is turned to the closed position, the support lever 18 is urged rearwardly by the sloped surface 21 of the cam 20. When cam 20 is rotated such that lever 18 contacts the cam 20, the support lever 18 is held at a closed position, causing the control plate 19 to close the inlet 14 of the cooling-air incoming passage 13.

In the refrigerator of FIG. 1, if both the freezing compartment 2 and the refrigerating compartment 3 are to be used, the knob 16 of the regulator 15 is placed at a selected position among "Low Cooling", "Middle Cooling", or "High Cooling", as in the conventional manner of the well-known refrigerator, thereby causing the plate 19 to open the inlet 14. Opening of the inlet 14 causes the cooling air from the evaporator 9 to flow into both the freezing and refrigerating compartments 2 and 3, so that both compartments 2 and 3 can be used. Also, when the amount of food to be refrigerated is small or the refrigerating compartment 3 is not to be used, the knob 16 of regulator 15 is turned to be placed at the closed position. In the closed position, the support lever 18 is urged rearwardly along and by the slope surface 21 of the cam 20, causing the plate 19 to close the inlet 14. With inlet 14 closed, the flow of cooling air through the passage 13 is prevented and the refrigerating compartment 3 is closed and only the freezing compartment 2 can be used. In this case, the freezing compartment 2 can be used selectively as either a freezing or as a refrigerating compartment under control of the switch 7.

FIG. 4 and FIG. 5 show another embodiment of a refrigerator to which this invention applies and wherein the evaporator **9*a* is disposed at the rear wall of the freezing compartment 2*a* and the refrigerating compartment 3*a* has a cooling-air flow regulator similar to that of the refrigerator of FIG. 1. As shown in FIG. 4 and FIG. 5, within the interior of the body 1*a* of the refrigerator, the freezing compartment 2*a* and the refrigerating compartment 3*a* are formed, the freezing compartment 2*a* being able to be used as a refrigerating compartment. A fan motor 10*a* carrying the fan 11*a* is mounted above the evaporator 9*a*. Between the bottom wall 6*a* of the freezing compartment 2*a* and the top wall 8*a* of the refrigerating compartment 3*a*, there are the cooling-air discharging passages 23, 24 for the compartments 2*a* and 3*a*, respectively, the passages 23, 24 being separated by a partition 22. A cooling-air incoming passage 13*a* for the refrigerating compartment 3*a* is formed and extends vertically in the rear wall 5*a* of the freezing compartment 2*a*. The passage 13*a* connects with the refrigerating compartment 3*a*. Inlet 14*a* of the passage 13*a* is provided with a cooling-air flow regulator 15*a* attached to the rear wall of the body 1*a* of the refrigerator. The regulator 15*a* comprises a control plate 19*a* movable to open and close the inlet 14*a*, a support lever 18*a* contacting slideably with the outer surface of the plate 19*a* and positioning the plate 19*a* through operation of control knob 16*a*. Control knob 16*a* is adapted to move the support lever 18*a* through cooperation with the rear surface cam 20 as described above. The cam 20 is adapted to control the position of the support lever 18*a*. A coil spring 25, connected at one end to inner surface of the plate 19*a* and at the other end to inner wall of the passage 13*a*, is compressed and thereby adapted to urge the plate 19*a* toward an opened position, that is outwardly and clockwise, as shown in FIG. 5**(*b*).

In the construction as described above, if the refrigerating compartment **3*a* is required to be closed, the control knob 16*a* is turned to the closed position, as shown in FIG. 5**(*a*). In the closed position, the cam **20*a* urges one end of the support lever 18*a*, causing the other end of the support lever 18*a* to urge the plate 19*a* toward the closed position, that is, inwardly and counter-clockwise, against the force of the spring 25. Thereby, inlet 14*a* of the passage 13*a* is closed by the plate 19*a***. In this embodiment, the same effects as in the aforementioned embodiment are obtained.

Figure 6:
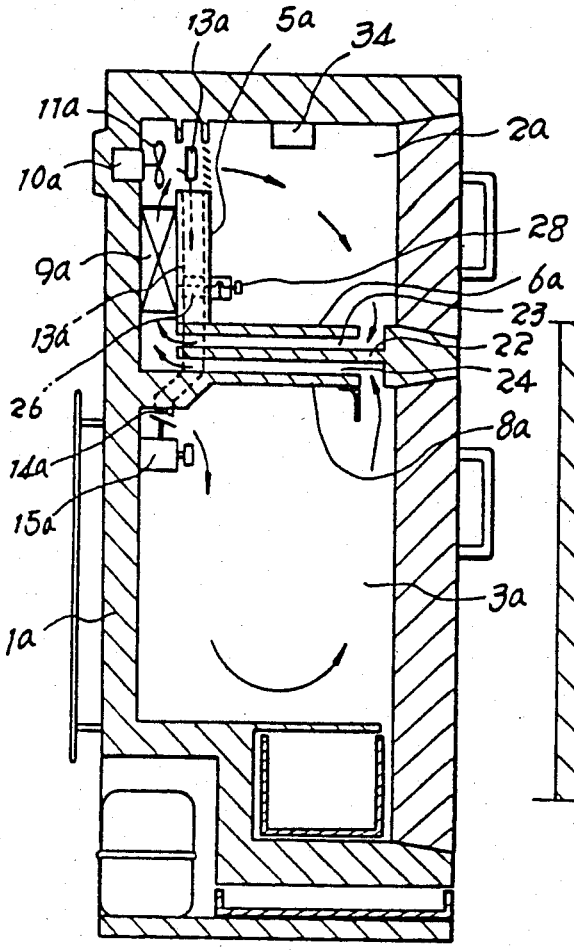
FIG. 6 is a cross-sectional view of a refrigerator according to another embodiment of this invention.
Figure 7:
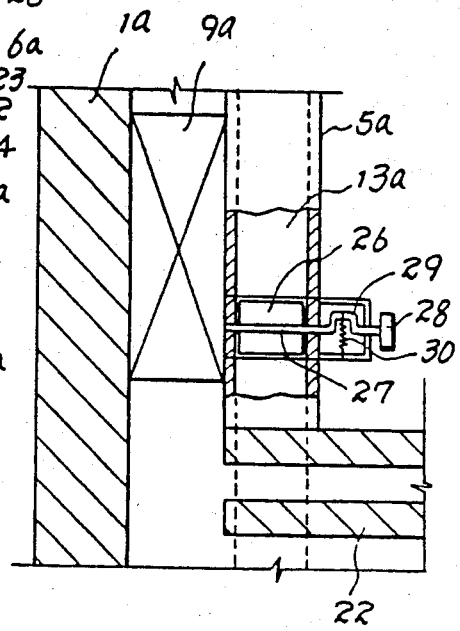
FIG. 7 is an enlarged cross-sectional view of a shutter in the cooling-air passage in the refrigerator of FIG. 6.

In accordance with another embodiment of the invention, closing of the cooling-air incoming passage may be effected by a shutter disposed independently at a certain position in said passage, rather than use of the cooling-air flow regulator as in the aforementioned embodiments. FIG. 6 and FIG. 7 illustrate different examples of such construction. FIGS. 8(*a*), 8(*b*) and 8(*c*) illustrate different forms of a shutter-adjusting device. The refrigerators for all of these devices is identical to that of FIG. 4, and accordingly, the same reference numerals indicate the same parts. In these embodiments, the shutter 26 is mounted, to move between opened and closed positions, at certain locations in passage **13*a* communicating with the refrigerating compartment 3*a*. Mounting of the shutter 26 in the passage 13*a* is carried out in various ways, several examples of which are illustrated in FIG. 8**.

Figure 8A:
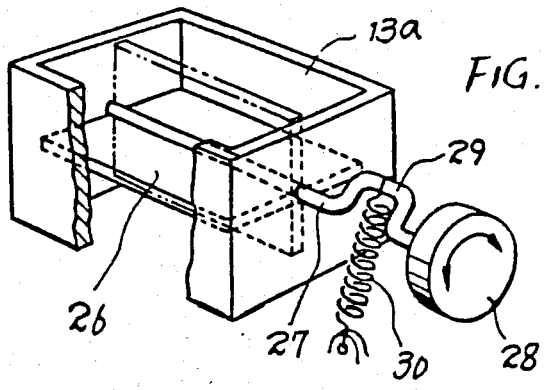
FIGS. 8(*a*), 8(*b*) and 8(*c*) each are perspective views of different examples of mounting the shutter in the cooling-air incoming passage of the refrigerating compartment.
Figure 8B:
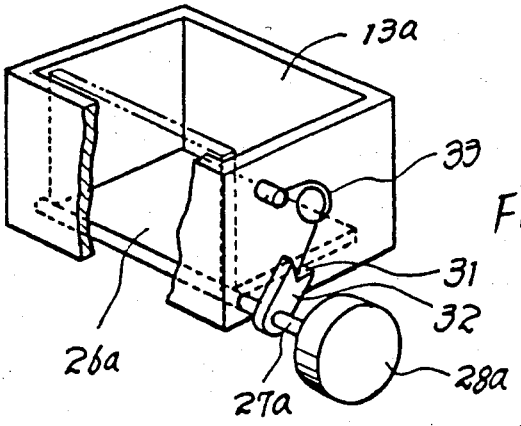
Figure 8C:
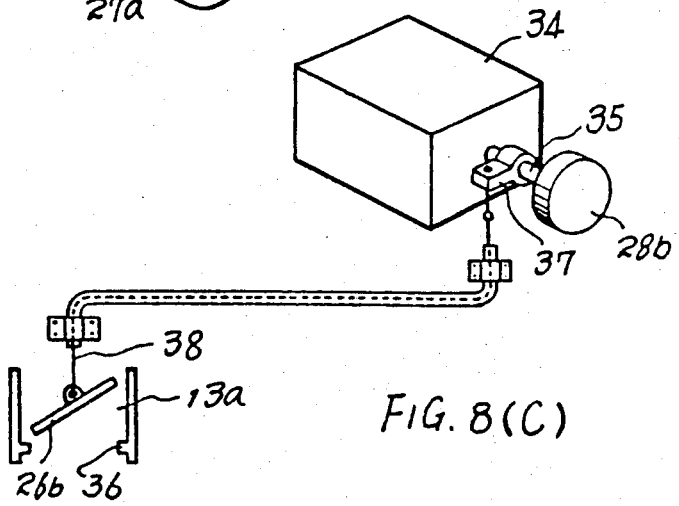

FIG. 8(*a*) shows an embodiment of the shutter, wherein the shutter 26 is rotatably attached to the drive shaft 27, enabling the passage 13*a* to be closed inside of the middle portion of the passage 13*a*. One end of the shaft 27 is extended outwardly from the passage 13*a* and is provided with an actuating knob 28. Rotation of the knob 28 clockwise or counter-clockwise results in closing or opening of the shutter 26. To hold the shutter 26 in opened or closed positions, a tension coil spring 30 is connected at one end to a protruded or curved portion 29 of the shaft 27, urging the shaft 27 downward. In this construction, when the refrigerating compartment 3*a* is used normally, the knob 28 is held at the opened position at which the shutter 26 is positioned vertically to open the passage 13*a*, as indicated by the broken line in FIG. 8(*a*) and thereby, to flow the cooling air into the refrigerating compartment 3*a*. When the refrigerating compartment 3*a* is not to be used, the knob 28 is turned to the closed position, whereby, the shaft 27 rotates to position the shutter 26 horizontally, as indicated by the solid line in FIG. 8*a* so that the passage 13*a* is closed to prevent flow of cooling air into the refrigerating compartment 3*a*. Thus, the refrigerating compartment 3*a* is closed.

FIG. 8(*b*) shows another embodiment for mounting the shutter in the cooling-air incoming passage 13*a*. In FIG. 8*b* the shutter 26*a* is connected at one lateral end to the shaft 27*a* mounted closely to one side wall of the passage 13*a*. One end of the shaft 27*a* is extended outwardly out of the passage 13*a* and is provided with an actuating knob 28*a*. Rotation of the knob 28*a* clockwise or counter-clockwise causes the shutter 26*a* to close or open the passage 13*a*. The shaft 27*a* carries a fixed protrusion member 32 having at the top end a V-shaped groove 31. A spring 33 is connected at one end to outer wall of the passage 13*a* and engaged at the other end with the groove 31, so that the shaft 27*a* is held at a selected position. Closing and opening of the cooling-air incoming passage 13*a* by rotation of the knob 28*a* is carried out in the same manner as above-mentioned.

FIG. 8(*c*) shows another embodiment for mounting the shutter in cooling-air incoming passage, wherein opening and closing of the shutter can be accomplished by the use of shaft 35 of the thermostat 34 mounted in the top portion of the freezing compartment 2*a*. In this embodiment, protruded from the inner wall of the cooling-air incoming passage 13*a* is a shutter seat 36 on which the shutter 26*b* is selectively placed to close the passage 13*a*. The shutter 26*b* connected to the shaft 35 of the thermostat 34 disposed in the freezing compartment 2*a*, by means of a wire 38 is connected at one end to the shutter 26*b* and at the other end to the wire-holding member 37, and thereby, to the shaft 35 of the thermostat 34. With this construction, rotation of the actuating knob 28*b* attached to the shaft 35 of thermostat 34 causes the wire 38 to be pulled and pushed, enabling open-close movements of the shutter 26*b*.

While preferred embodiments of the invention have been described using specific terms, such description is for illustrative purposes only, and it is to be understood that changes and variations may be made without departing from the scope of the following claims.

What is claim is:

1. A refrigerator including a temperature-controlling thermostat and an evaporator comprising:

(a) a freezing compartment having said temperature-controlling thermostat therein and being able to be used as a refrigerating compartment, (b) a refrigerating compartment positioned below said freezing compartment, (c) cooling-air incoming passages connected to each of said compartments at inlets for supplying cooling air from said evaporator into each of said compartments, (d) a cooling-air flow regulator, located at the refrigerating compartment inlet of the cooling-air incoming passage, said regulator adjustably to be open for permitting the flow of cooling air and adjustable to be completely closed for preventing the flow of cooling air into said refrigerating compartment, said regulator including:

(i) a regulator body, (ii) a flexible actuating member which is mounted on said regulator body, (iii) a support lever rotatably mounted by pivot pin on said regulator body in front of said actuating member and having a curved portion, (iv) a shutter which is attached to and supported by a top end of said support lever, said shutter disposed rotatably in said refrigerating compartment and operated by said support lever to close or open said refrigerating compartment inlet for increasing or decreasing the flow of cooling air through the cooling-air incoming passage, (v) a control member which is rotatably connected to said regulator body, said member having indications of cooling extent, an indication of complete closing position for said shutter on the front face thereof, having a cam device being formed by a top plane in the opposite side of said indication of complete closing position and a sloped surface annularly extended from one side of said top plane to the other side of said top plane, so that said control member operates to urge rearwardly the curved portion of said support lever by said cam device and to fix said support lever at the position for complete closing of said shutter.

* * * * *